US005893254A

United States Patent [19]

Troiani et al.

[11] Patent Number: 5,893,254

[45] Date of Patent: Apr. 13, 1999

[54] BRICK WALL ON PIERS

[75] Inventors: Sante Troiani; Aloysius Sydney Moyle, both of Bandaberg, Australia

[73] Assignee: Wide Bay Brickworks Pty. Ltd., Bundaberg, Australia

[21] Appl. No.: 08/765,325

[22] PCT Filed: Apr. 25, 1995

[86] PCT No.: PCT/AU95/00249

§ 371 Date: Dec. 24, 1996

§ 102(e) Date: Dec. 24, 1996

[87] PCT Pub. No.: WO96/00333

PCT Pub. Date: Jan. 4, 1996

[30] Foreign Application Priority Data

Jun. 24, 1994 [AU] Australia ..... PM6453

[51] Int. Cl.[6] ..... E04B 2/88; E04G 21/14

[52] U.S. Cl. ..... 52/169.9; 52/295; 52/439; 52/508; 52/741.13; 52/741.15; 52/745.12; 52/747.12

[58] Field of Search ..... 256/19; 52/169.9, 52/295, 299, 379, 381, 383, 741.13, 741.15, 745.09, 745.12, 747.1, 747.12, 339, 442, 508

[56] References Cited

U.S. PATENT DOCUMENTS

| | | | |
|---|---|---|---|
| 829,397 | 8/1906 | Gerber | 256/19 |
| 2,022,551 | 11/1935 | Thompson | 52/169.9 |
| 2,057,018 | 10/1936 | Dillon | 256/19 |
| 3,698,692 | 10/1972 | Burrows, Jr. | 256/19 |
| 4,123,889 | 11/1978 | Deloupy | 52/747.12 |
| 4,409,766 | 10/1983 | Blackmore | 52/741.13 |
| 5,623,797 | 4/1997 | Gravier et al. | 256/19 |

FOREIGN PATENT DOCUMENTS

| | | |
|---|---|---|
| 4167485 | 3/1986 | Australia . |
| 4821785 | 4/1986 | Australia . |

*Primary Examiner*—Michael Safavi
*Attorney, Agent, or Firm*—Iandiorio & Teska

[57] ABSTRACT

A brick wall is constructed on spaced piers (11). The bottom courses (13, 14) of bricks in the brick wall are of opposed channel section and form a longitudinal bore therebetween. Steel reinforcing is located in the bore before it is filled with grout to form a composite brick bond beam spanning between adjacent piers (11). The bond beam provides a support for successive courses of bricks (19) laid thereon. The brick wall can be used as cladding for an existing wall (10). The bricks in the upper courses (19) may be of narrower width than those used to form the composite brick bond beams. The courses (19) may be secured to the external panels (21) of the existing wall by wall ties (20). Single skin walls may also be constructed according to this method.

11 Claims, 3 Drawing Sheets

BRICK WALL ON PIERS

This Invention relates to a method of constructing a brick wall, and to a wall when constructed by that method. In particular, the invention is directed to a method for constructing brick cladding for an existing structure, although the invention is not limited thereto.

Throughout the specification, the term "brick" is intended to include a building block whether constructed of clay, cementitious material, or other material. The term "pier" as used in this specification is intended to include a post, pile, discrete footing, or similar support structure.

BACKGROUND ART

The advantages of brick walls for houses and other buildings have long been recognised. Many owners of buildings having timber walls often wish to construct brick outer walls (or "cladding") for the building. However, known brick cladding methods are time consuming, labour intensive, and relatively expensive.

Normally, it is necessary to dig a trench around the building, close to the existing walls, in order to provide footings for the brick wall to be erected. Since water pipes, gas and/or electricity lines, telephone lines and other utilities are often located underground leading to the building, the construction of those footing trench requires the interruption of the services. Moreover, these service lines may be inadvertently cut or ruptured when digging the trench.

The footing trench also interferes with access to the building.

Another problem associated with such footing trenches is the weakening or removal of support for the existing building.

Trench footings are not recommended for reactive soils, such as clay, as the movement of the soil with changing environmental conditions causes movement of the foundations, and hence the brick wall supported by the foundations. This leads to cracking, and possible failure of the brick wall.

It is an object of the present invention to provide an improved method of constructing a brick wall, particularly but not solely for use as a cladding wall, which overcomes or ameliorates the abovedescribed disadvantages, or which at least provides the builder with a useful choice.

SUMMARY OF THE INVENTION

In one broad form, the present invention provides a method of forming a brick cladding wall for a preexisting building, comprising the steps of providing a plurality of spaced piers adjacent an exterior wall of the building, forming a horizontal support beam spanning between an adjacent pair of piers and supported thereon, and laying successive overlaying courses of bricks on the support beam to form a wall.

According to this invention, the brick wall is supported on the spaced piers. Normally, when erecting a wall on piers, it is necessary to provide a supporting member, such as a bond beam or lintel to support the wall, between the piers. However, it has been found that a support structure can be formed from two or more lowermost courses of bricks. An elongate reinforcing member, such as a steel reinforcing rod, is located between adjacent lower courses. Typically, opposed open longitudinal channels are formed in the bricks of adjacent lowermost courses, and the reinforcing rod is located within the composite bore formed by the opposing channels. The remainder of the bore is filled with grout. In this manner, the reinforced corefilled courses of bricks form an effective bond beam which spans between the piers and supports the brick wall.

Typically, the bricks in the lower courses have a larger width than the bricks in the higher courses.

The abovedescribed method is particularly suitable for constructing brick cladding walls for existing buildings. Instead of digging a trench around the building to provide the wall footings, it is only necessary to sink piers at spaced locations around the building, thereby minimising interference or disruption to building access and services. The piers are preferably smooth sided to eliminate or minimise any movement on the piers in response to soil movement. Thus, this method of wall construction is particularly suitable for use in reactive soils.

In another form, the invention provides a method of forming a brick wall, comprising the steps of providing a plurality of spaced piers, forming a horizontal support beam spanning between an adjacent pair of piers and supported thereon, the support beam being formed from a plurality of courses of bricks having a longitudinally extending steel reinforced cementitious core, and laying further courses of bricks on the support beam to form the wall.

In order that the invention may be more fully understood and put into practice, preferred embodiments thereof will now be described with reference to the accompanying drawings.

DESCRIPTION OF PREFERRED EMBODIMENTS

Figure 1:
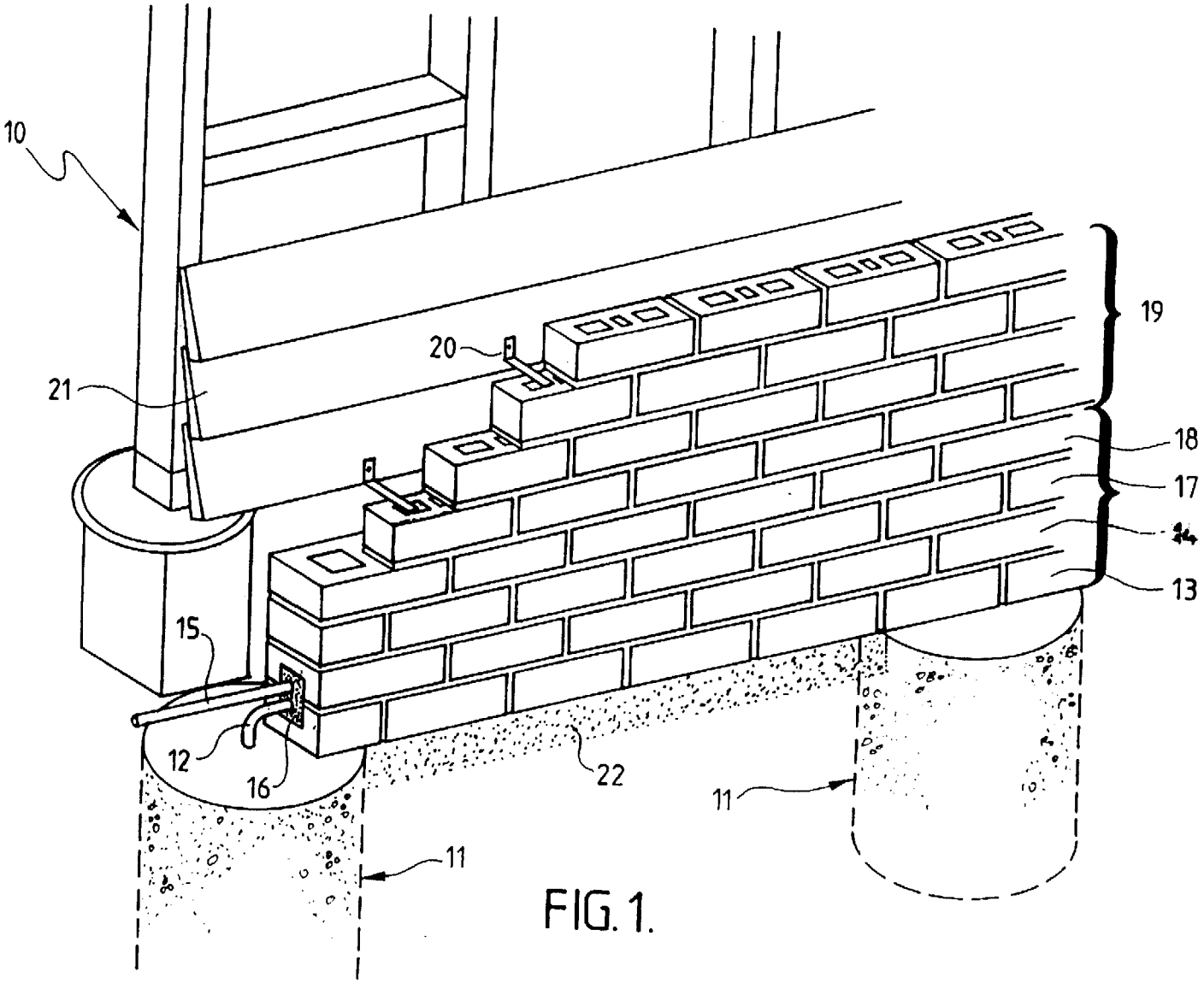
FIG. 1 is a perspective view of a partially constructed brick cladding wall according to one embodiment.
Figure 3:
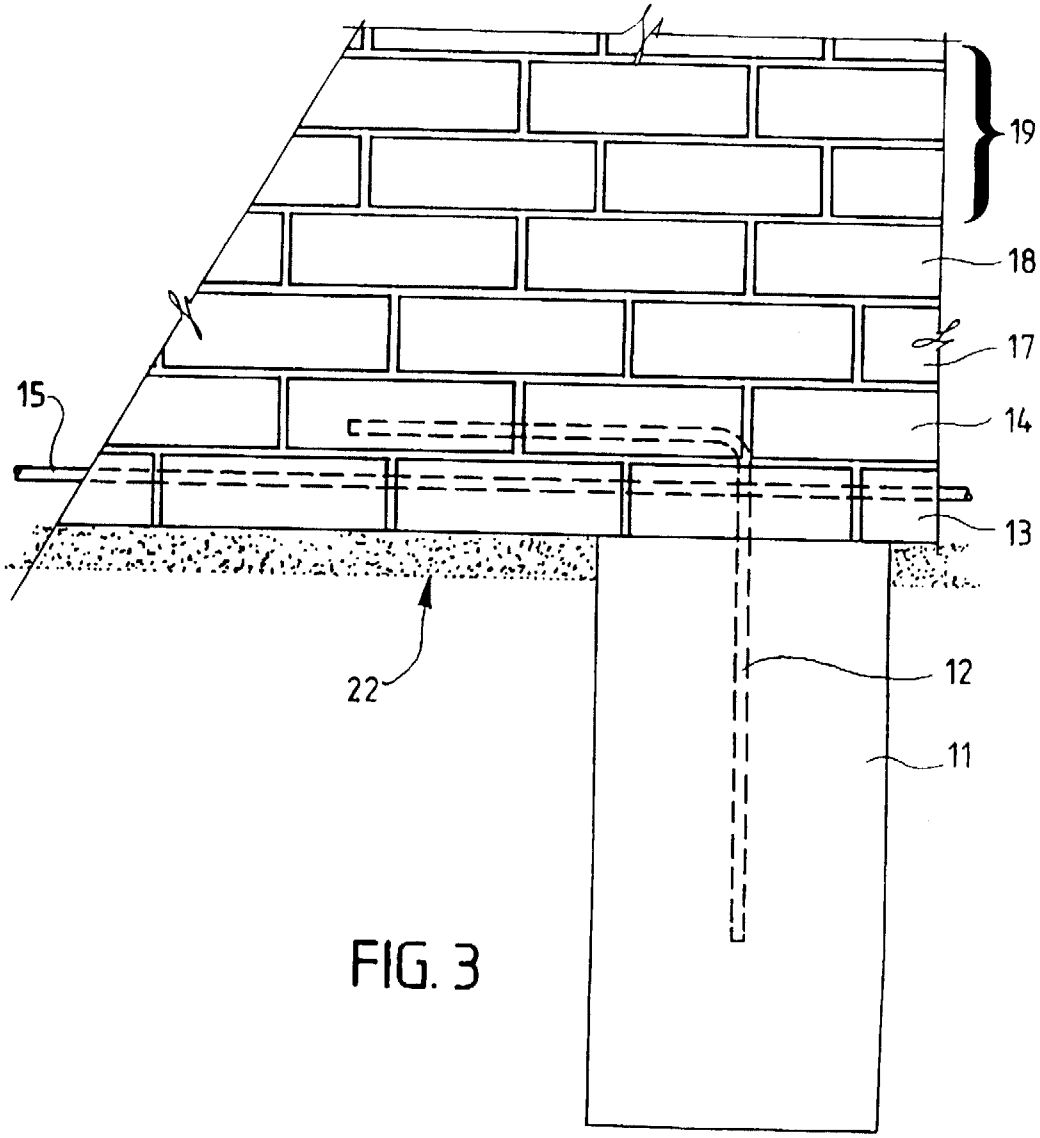
FIG. 3 is a fragmentary side elevation of the wall.

As shown in the drawings, spaced concrete piers 11 are sunk or otherwise formed outside an existing wall 10, in close proximity thereto. The piers 11 are suitably steel reinforced. The positioning of the concrete piers 11 can be chosen to suit the particular situation, e.g. to avoid water pipes and other underground utilities. Each concrete pier 11 has at least one steel reinforcing rod 12 protruding from the top.

A first (lowermost) course of bricks 13 is laid across the top of the piers 11 on a compacted sand bed 22 which is level with the tops of the piers. (Alternatively, to support the bricks between the piers, a temporary support arrangement (not shown) may be provided, such as a plank or the like).

Figure 2:
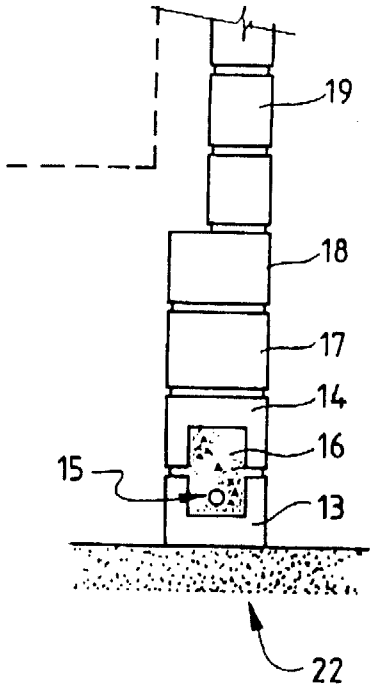
FIG. 2 is an end elevation of the wall.

The bricks 13 may suitably be 110 mm wide CORAL SEA™ clay bricks manufactured by the applicant. The centre portions of each brick 13 are partially removed so that a longitudinal open channel is formed along the course of bricks 13 as can be seen in FIG. 2. The reinforcing rods 12 protruding from the piers 11 are suitably bent and located in this channel. One or more reinforcing rods 15 are also laid in the channel along the complete length of the course 13.

A second course of bricks 14 is laid over the first course 13. The bricks 14 in the second course may also have a longitudinal channel formed therein, and are laid in opposed facing relationship to the bricks in the first course, so that a composite hollow core 16 is formed longitudinally, between the courses 13, 14.

Figure 4:
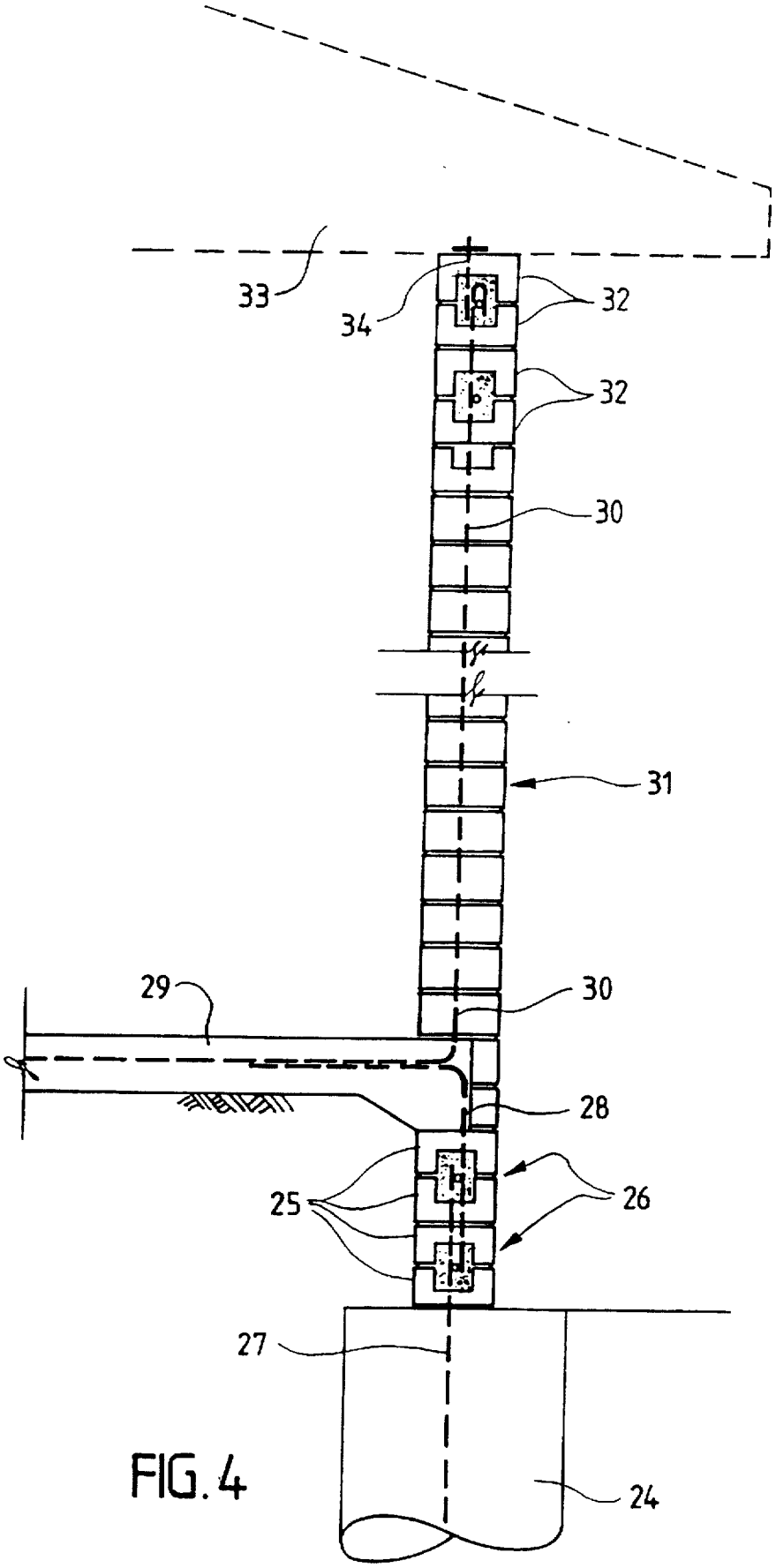
FIG. 4 is a sectional end elevation of a wall according to another embodiment.

The core 16 is filled with grout, typically of 15 mPa strength. After the core has set, additional courses of bricks 17, 18 may be laid. Additional reinforcing (not shown) may be inserted in cores formed between courses 17, 18, if required (as shown in FIG. 4), and such cores filled with grout.

Additional courses of bricks 19 are then laid on the bottom courses as illustrated. Metal ties 20 are suitably provided between the courses of bricks 19 and the existing exterior timber wall 21. Conveniently, the bricks in the upper courses 19 have a narrower width than the bricks in the lowermost courses. The bricks 19 may suitably be 70 mm wide KIWI™ clay bricks manufactured by the applicant.

The reinforced, corefilled courses 13, 14, 17, 18 effectively form a complete bond beam which spans between the concrete piers 11 and supports the additional courses of bricks 19 which complete the wall.

To accommodate windows, window frames are suitably provided to span between the existing wall 10 and the brick cladding wall.

The abovedescribed method avoids the need to dig trenches for wall footings. The piers may be located at desired spaced locations, thereby avoiding underground services and allowing access to the building between the piers. Moreover, conventional concrete bond beams are not required, and the wall has a uniform appearance.

Another advantage of the abovedescribed method is that the existing outer wall panels 21 need not be removed prior to brick cladding. This is particularly advantageous if the outer wall panels 21 contain asbestos fibres as the removal of such panels involves stringent safety requirements.

Although the above construction method has been described with particular reference to cladding of existing buildings, the method can also be used to construct brick walls in the first instance.

As shown in FIG. 4, piers 24 are sunk or otherwise formed at spaced locations, and steel reinforced brick bond beams 26 are formed from courses of bricks 25 to span between adjacent piers 24 as described above. Steel reinforcing rods 27 in the piers 24 protrude above the upper surface of the piers 24, to form starter bars. The bond beams 26 are formed around the starter bars so that the starter bars hold the bond beams 26 securely onto the piers 24. The starter bars are connected to further reinforcing bars 28, the tops of which are bent horizontal as shown in FIG. 4. Formwork is erected around the bars 28, and concrete is poured within the formwork to form a floor 29 supported on the bond beams 26. Before the concrete is poured, upright reinforcing rods 30 have their angled feet positioned within the formwork so as to be embedded in the concrete floor 29. Successive courses of bricks 31 are then laid on top of the concrete floor 29, the reinforcing bars 30 being located within apertures in the bricks 31.

If desired, upper composite brick bond beams 32 can be formed at the top of the wall in a manner similar to that described above. The reinforcing bar 30 is bent over horizontal steel reinforcing bars in the bond beams 32 so that the whole wall is securely anchored to the floor 29 and to the piers 24. If desired, the bond beams 32 may include short upright bars protruding from the top thereof, for tying down the roof rafters 33. In this manner, the rafters 33 are tied to the wall, and hence the piers 24, thereby providing resistance to high wind loads, such as those experienced in cyclonic areas.

The foregoing describes only some embodiments of the invention, and modifications which are obvious to those skilled in the art may be made thereto without departing from the scope of the invention as defined in the following claims.

For example, the number of reinforced corefilled courses can be varied to suit the particular application, and is dependent on such factors as loading, pier spacing, etc.

We claim:

1. A brick wall comprising:

a plurality of spaced piers;

a horizontal support beam spanning between at least a pair of piers and supported thereon, said support beam being a composite brick bond beam formed from a plurality of courses of bricks and having a longitudinally extending reinforced cementitious core, wherein at least one of the courses of bricks has a channel extending longitudinally therein, and the reinforced core comprises at least one elongate reinforcing member located in the channel and encased in cementitious material in the channel; and a plurality of courses of bricks on the support beam.

2. A brick wall as claimed in claim 1, wherein the bond beam is formed from a pair of courses of bricks having opposed channel sections forming a composite core extending longitudinally therebetween, the core having a steel reinforced rod extending therethrough and being substantially filled with the cementitious material.

3. A brick cladding wall as claimed in claim 1, wherein bricks in courses above the support beam are of narrower width than the bricks forming the support beam.

4. A brick wall as claimed in claim 1 wherein the piers are substantially smooth sided.

5. A brick wall as claimed in claim 1 wherein the wall is a brick cladding wall for a building, the piers being located adjacent an exterior wall of the building.

6. A method of forming a brick cladding wall for a pre-existing building, comprising the steps of:

providing a plurality of spaced piers adjacent an external wall of the building;

forming a horizontal support beam spanning between at least a pair of piers and supported thereon; and laying successive overlaying courses of bricks on the support beam to form a wall, characterized in that the support is a composite brick bond beam formed from a plurality of courses of bricks and having a reinforced core, wherein at least one of the courses of bricks has a channel extending longitudinally therein, and the reinforced core comprises at least one elongate reinforcing member located in the channel and encased in cementitious material in the channel.

7. A method as claimed in claim 6, wherein the bond beam is formed from a pair of courses of bricks having opposed channel sections forming a composite core extending longitudinally therebetween, the course having a steel reinforcing rod extending therethrough and being substantially filled with the cementitious material.

8. A method as claimed in claim 6, wherein bricks in courses above the support beam are of narrower width than the bricks forming the support beam.

9. A method of forming a brick wall, comprising the steps of:

providing a plurality of spaced piers;

forming a horizontal support beam spanning between an adjacent pair of piers supported thereon, the support beam being formed from a plurality of courses of bricks and having a longitudinally extending, reinforced cementitious core, wherein at least one of the courses of bricks has a channel extending longitudinally therein, and the reinforced core comprises at least one elongate reinforcing member located in the channel and encased in cementitious material in the channel, and laying further courses of bricks on the support beam to form the wall.

10. A method as claimed in claim 9, wherein the support beam is formed from a pair of courses of bricks having opposed channel sections forming a composite core extending longitudinally therebetween, the core having a steel reinforcing rod extending therethrough and being substantially filled with cementitious material.

11. A method as claimed in claim 9, wherein bricks in courses above the support beam are of narrower width than the bricks forming the support beam.

* * * * *